US008826792B1

(12) United States Patent
Granger

(10) Patent No.: US 8,826,792 B1
(45) Date of Patent: Sep. 9, 2014

(54) PROJECTILE PROPULSION METHOD AND APPARATUS

(76) Inventor: Christopher George Granger, Kennesaw, GA (US)

( * ) Notice: Subject to any disclaimer, the term of this patent is extended or adjusted under 35 U.S.C. 154(b) by 783 days.

(21) Appl. No.: 12/400,787

(22) Filed: Mar. 9, 2009

Related U.S. Application Data

(60) Provisional application No. 61/034,983, filed on Mar. 9, 2008.

(51) Int. Cl.
*F41A 1/04* (2006.01)

(52) U.S. Cl.
USPC ..... 89/7

(58) Field of Classification Search
USPC ..... 89/7; 124/73, 74, 75
See application file for complete search history.

(56) References Cited

U.S. PATENT DOCUMENTS

| | | | | | |
|---|---|---|---|---|---|
| 1,359,295 | A * | 11/1920 | Trumble | 89/7 |
| 3,346,984 | A * | 10/1967 | Lohr | 42/55 |
| 3,951,038 | A * | 4/1976 | Van Langenhoven | 89/7 |
| 4,231,282 | A * | 11/1980 | Ashley | 89/7 |
| 4,341,147 | A * | 7/1982 | Mayer | 89/7 |
| 4,644,843 | A * | 2/1987 | Soper | 89/7 |
| 4,664,631 | A * | 5/1987 | Pederson et al. | 434/16 |
| 4,949,621 | A * | 8/1990 | Stephens | 89/7 |
| 4,967,638 | A * | 11/1990 | Bulman | 89/7 |
| 5,202,530 | A * | 4/1993 | Stephens | 89/7 |
| 5,499,567 | A * | 3/1996 | Gay | 89/7 |
| 7,665,396 | B1 * | 2/2010 | Tippmann, Jr. | 89/7 |
| 2002/0170552 | A1 * | 11/2002 | Gardner, Jr. | 124/56 |
| 2008/0190275 | A1 * | 8/2008 | Tippmann | 89/7 |
| 2010/0212481 | A1 * | 8/2010 | Koth | 89/7 |

* cited by examiner

*Primary Examiner* — Bret Hayes

(57) ABSTRACT

One embodiment of a projectile propulsion method and apparatus comprising a combustion chamber means and valve means enabling cartridge-free projectile propulsion. The embodiment may be implemented with selective-fire and/or variable velocity projectiles. The embodiment employs liquid and/or gaseous propellants which can be injected into the device and combusted to provide the necessary pressures for propelling a projectile. Some variations and alternatives are described.

29 Claims, 3 Drawing Sheets

PROJECTILE PROPULSION METHOD AND APPARATUS

CROSS-REFERENCE TO RELATED APPLICATIONS

This application claims the benefit of provisional application for patent Ser. No. 61/034,983, filed 2008 Mar. 9 by the present inventor.

FEDERALLY SPONSORED RESEARCH

Not Applicable

SEQUENCE LISTING OR PROGRAM

Not Applicable

BACKGROUND

1. Field of Invention

This invention relates to projectile propulsion methods and apparatuses, specifically to cartridge-free projectile propulsion.

2. Prior Art

Projectile propulsion using traditional cartridge-based rounds have inherent disadvantages including ammunition weight and volumetric inefficiencies, cartridge "policing" and spent brass, cartridge ejection issues, ammunition storage and logistics problems, ammunition transport issues, cartridge manufacture, overall cost, propellant availability, and other drawbacks. Solutions that can provide competitive alternatives have long been sought and are in significant demand. Projectile-based weapons, for instance, are one application where practical cartridge-free solutions would be a tremendous advantage. Prior to this invention, however, there were no viable solutions which enabled cartridge-free projectile propulsion methods to be competitive with cartridge rounds within the same domain.

Experiments have been conducted with devices such as rail guns and ram accelerators, but their practicality in most domains has not been theoretically nor experimentally demonstrated with any assuredness, at least not in the short and mid terms. On the other hand, injection combustion techniques (a term used to describe those systems whereby a propellant or propellants is injected into a combustion chamber, as in an automobile or rocket engine) could provide an effective means of projectile propulsion in general, including within the domain currently dominated by traditional cartridge techniques.

One can calculate that, due to the abundance of available energy inherent in the technique, the system is viable, provided enough power could be delivered to the projectile in a reasonably efficient manner. Until this invention, existing projectile propulsion devices using any variant of injection-combustion style techniques, inclusive of all such devices in even in the broadest sense (including high-end experimental light gas guns down to recreational devices such as "spud-guns") have not developed the physical nor theoretical mechanisms whereby such injection-combustion techniques could be used in a practicably competitive fashion with cartridge rounds within the current cartridge-based device domain. For instance, there exists a commercially available paintball launching device employing propane; this device does not possess the required mechanisms for automatic propellant injection, full/semi-automatic fire, or the required higher-power capacities for operating in the domain dominated by cartridge-based devices, among other deficiencies. Additionally, injection-combustion devices which exhibit selective-fire and/or variable-velocity projectiles have not been demonstrated in the scientific/research areas or recreational domains, areas which have been dominated by powder and/or compressed gas devices.

Projectile propulsion devices using injectable propellants have resulted in patents, but research has not indicated that any have resulted in a viable practical implementation of such a device, specifically regarding a system which could compete with cartridge-based solutions and/or provide variable velocity projectiles or full-automatic firing capabilities.

Previous considerations using injectable fuels for projectile propulsion have been regarded as a reasonable choice since at least 1890, when Hiram S. Maxim received U.S. Pat. No. 424,119, "Gun", for a device using fuel-air mixtures to propel grenades; this device was directed in scope towards single-shot, low-pressure grenade-type projectiles. Patents including U.S. Pat. No. 2,088,503 ("Cannon"), U.S. Pat. No. 2,965,000 ("Liquid Propellant, Regenerative Feed and Recoiless Gun"), U.S. Pat. No. 3,160,064 ("Liquid Propellant Gun"), U.S. Pat. No. 3,888,159 ("Liquid Propellant Weapon"), U.S. Pat. No. 4,005,632 ("Liquid Propellant Gun"), U.S. Pat. No. 4,993,309 ("Liquid Propellant Weapon System"), and U.S. Pat. No. 5,591,932 ("Break Action Cannon"), all refer to the use of liquid fuels for powering weapon projectiles. Most refer to large caliber weapons, either bulk-loaded or regenerative liquid propellant guns (RLPGs); these systems have difficulties in propellant feed, combustion stability, and machine complexity; plus, there is no indication of how such could be adopted for a small arms domain, or employ variable velocity projectiles, or in most cases be adapted for full-automatic or selective-fire capabilities; none appear adaptable or flexible enough for general purpose application. Moreover, practical implementation of a viable platform has not yet been shown as feasible.

Novel mechanisms are therefore required to advance injection-combustion techniques in order to develop viable alternatives for projectile propulsion applications. Such advancements include items such as propellant injection and metering systems, valve mechanisms, specific cycling operational methods, and other items. In addition to providing an alternative to cartridge-based systems, general projectile propulsion applications (ranging from scientific/research to recreation) would also benefit from the improvements in such techniques.

SUMMARY

This invention, an improved means of injection-combustion projectile propulsion and related apparatus, includes novel combinations of propellant metering systems, valve techniques, and cycling methods. Devices employing such techniques can provide a unique projectile propulsion means that could rival cartridge-based systems in certain embodiments, and can also provide devices and techniques usable in various applications, including lethal and non-lethal weapons, power tools, recreational devices, toys, and other applications.

DRAWINGS

DETAILED DESCRIPTION

Figure 1:
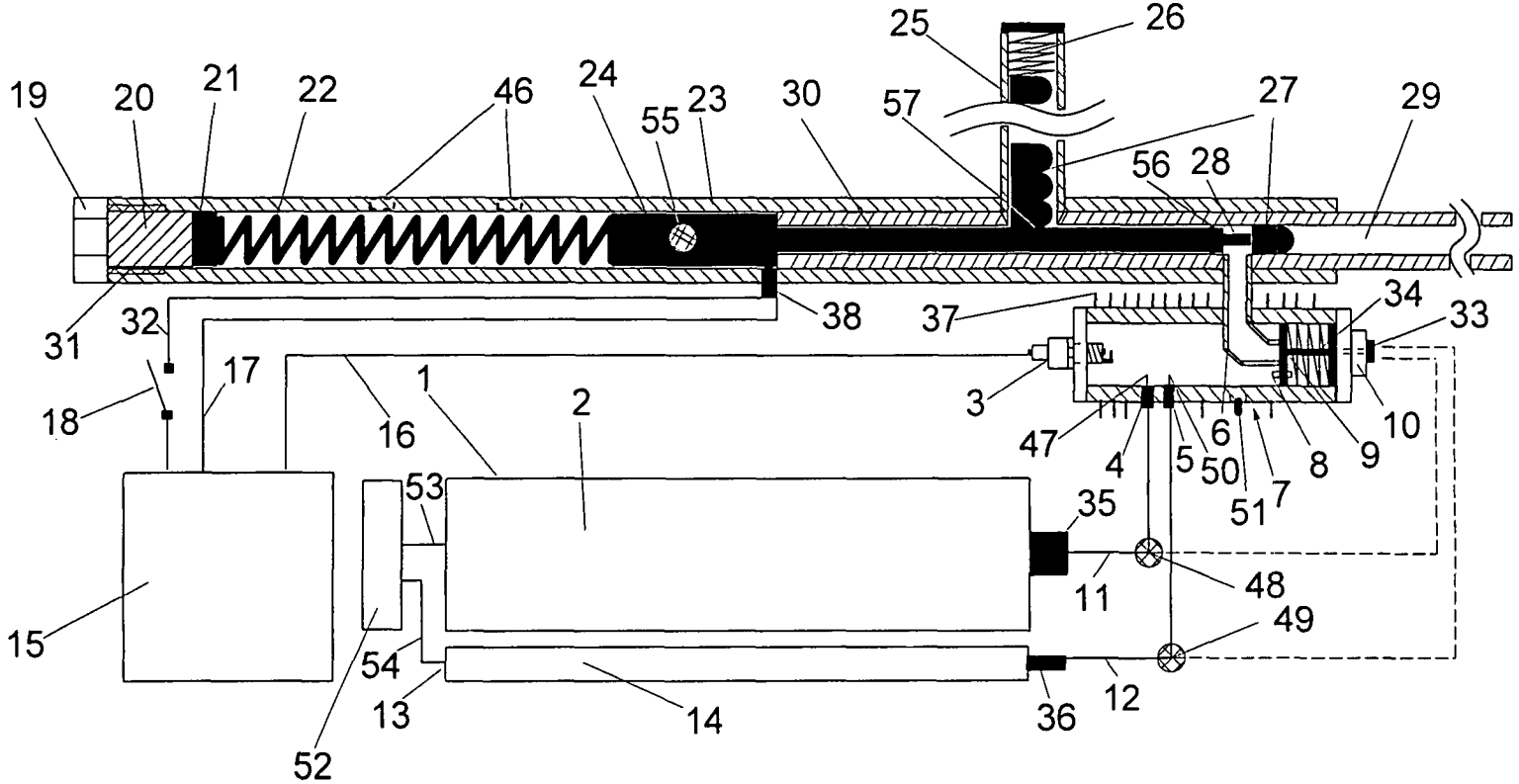
FIG. 1 is a cross sectional side view depicting one possible functional embodiment constructed in accordance with my invention.

FIG. 1 is a cross-sectional view depicting the right side of one possible functional embodiment of a device constructed in accordance with this invention. Oxidizer tank 1 contains a suitable oxidizer 2. Oxidizer 2 feeds into combustion chamber/valve assembly 7 through oxidizer regulator/valve 35, oxidizer tube 11, oxidizer check valve 4, and oxidizer injector 47. Fuel tank 13 contains a suitable fuel 14. Fuel 14 feeds into combustion chamber/valve assembly 7 through fuel regulator/valve 36, fuel tube 12, fuel check valve 5, and fuel injector 50. Optional oxidizer pump 48 and fuel pump 49 may be employed depending on specific implementation. Barrel 29 is a tube of suitable material (such as steel), a selected design diameter (i.e., projectile caliber), and a selected length, as dictated by the specific application, and connected to combustion chamber/valve assembly 7 via a receptacle hole which is also machined into upper receiver 23, through which gas port 6 is inserted and secured in a gas-tight fashion. Ammo holder 25 holds projectiles 27 under tension by ammo holder spring 26. Upper receiver 23 is a suitable material tube housing bolt block 24, bolt 30, bolt spring 22, bolt stop 21, bolt spring tensioner 20, and a rear portion of barrel 29 that is securely affixed in position via weld and/or retaining bolts. Ammo holder 25 can be inserted into a slot machined into upper receiver 23, fitting flush with the upper receiver as not to protrude into bolt 30 when the bolt is forward; the area a projectile will move through upon bolt 30 being retracted is loading port 57. Bolt block 24 and bolt 30 may by machined as one piece from solid rod, or bolt 30 may be securely attached to bolt block 24 by any appropriate means. Bolt face 28 may be machined from bolt 30 or securely attached as a separate rod. Bolt handle 55 is attached to bolt block 24 via secure push fit, drill/tap or other appropriate means. Bolt handle length and diameter will depend on specific implementation, and the bolt handle shaft rides through a slot machined in upper receiver 23, with the slot running from roughly bolt block 21 to just past the location of bolt handle 55 with bolt 30 fully forward (refer to FIG. 4, bolt handle slot 60, for the placement of the bolt handle slot). Vents 46 are optional additional vent holes in upper receiver 23. Normally closed bolt switch 38 and normally closed trigger switch 18 are connected in series to ignition circuit 15, via wires 17 and 32. High voltage output wire 16 is connected from ignition circuit 15 to spark plug/gap 3 (the output of an ignition coil, for instance, may represents high voltage output wire 16). Spark plug 3 is mounted in a gas tight fashion through a hole in combustion chamber/valve assembly 7. Oxidizer check valve 4 and fuel check valve 5 are mounted in a gas tight fashion within through holes in combustion chamber/valve assembly 7. Gas port 6 is mounted in a gas tight fashion through a hole in combustion chamber/valve assembly 7. Combustion vent 51 is an adjustable relief valve mounted in a gas tight fashion through a hole in combustion chamber/valve assembly 7. Piston valve 9 makes a reasonably gas tight sliding seal with the internal walls of combustion chamber/valve assembly 7. In this particular embodiment, piston valve 9 includes a valve stem that is connected to piston vent 33 which seals a vent hole machined in the in the combustion chamber/valve assembly; when piston valve 9 is fully closed, piston vent 33 is fully sealed. In some embodiments it would also be possible to dispense with piston vent 33 and leave the vent hole open, provided a gas-tight seal can be insured between piston valve 9 and the combustion chamber area (via an internal ridge or other construct), namely when piston valve 9 is fully closed. Similarly, an internal ridge or other construct can be used to seal the area behind the piston valve 9 via piston valve 9 itself when the piston valve is fully open, if such is required for performance or other reasons. Valve spring 34 fits in between piston valve 9 and the wall of combustion chamber/valve assembly 7, and is sized as appropriate for the specific implementation. Optional check valve 8 may be located in a hole machined through piston valve 9, and affixed via gas-tight seal, in some alternative variations. Depending on the variation and/or application, optional check valve 8 might be oriented in either direction. Depending on the variation and/or application, combustion chamber/valve assembly 7 might be located in an alternative position and/or orientation; as such, corresponding and/or interconnected components must be adjusted for proper operation. As noted, optional oxidizer pump 48 and fuel pump 49 may be connected in-line with their respective propellant tubes 11 and 12 in some alternative constructs. Oxidizer tube 11 and fuel tube 12 may be optionally routed to use an alternative valve port system as indicated by dashed lines in FIG. 1, and will be further described in the operation section. Optional external pressure tank 52, oxidizer pressure feed 53 and fuel pressure feed 54 may also be employed in some specific implementations as will be discussed in later sections.

Figure 2:
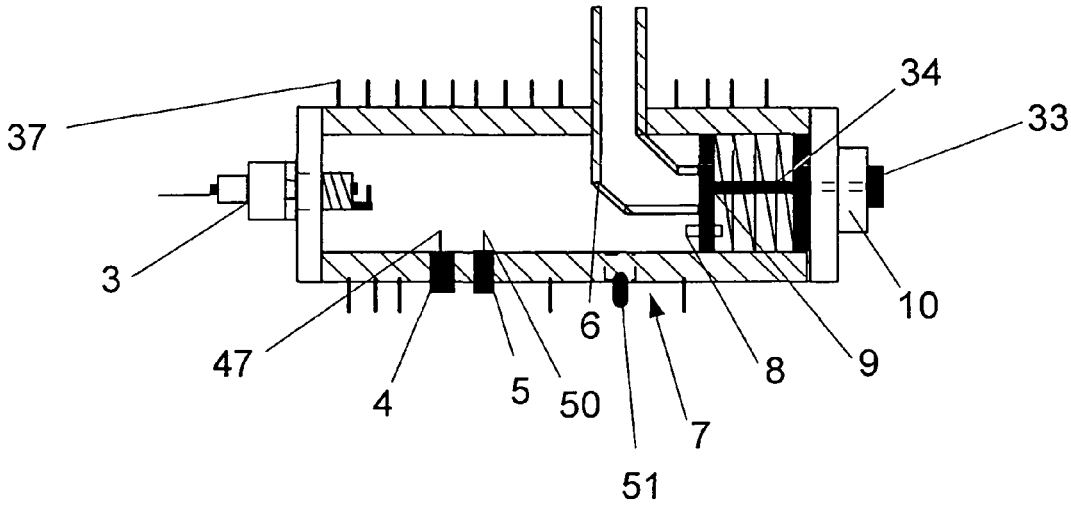
FIG. 2 is an enlarged cross-sectional view of combustion chamber/valve assembly 7 indicated in FIG. 1.

FIG. 2 is an enlarged cross-sectional view of combustion chamber/valve assembly 7.

Figure 3:
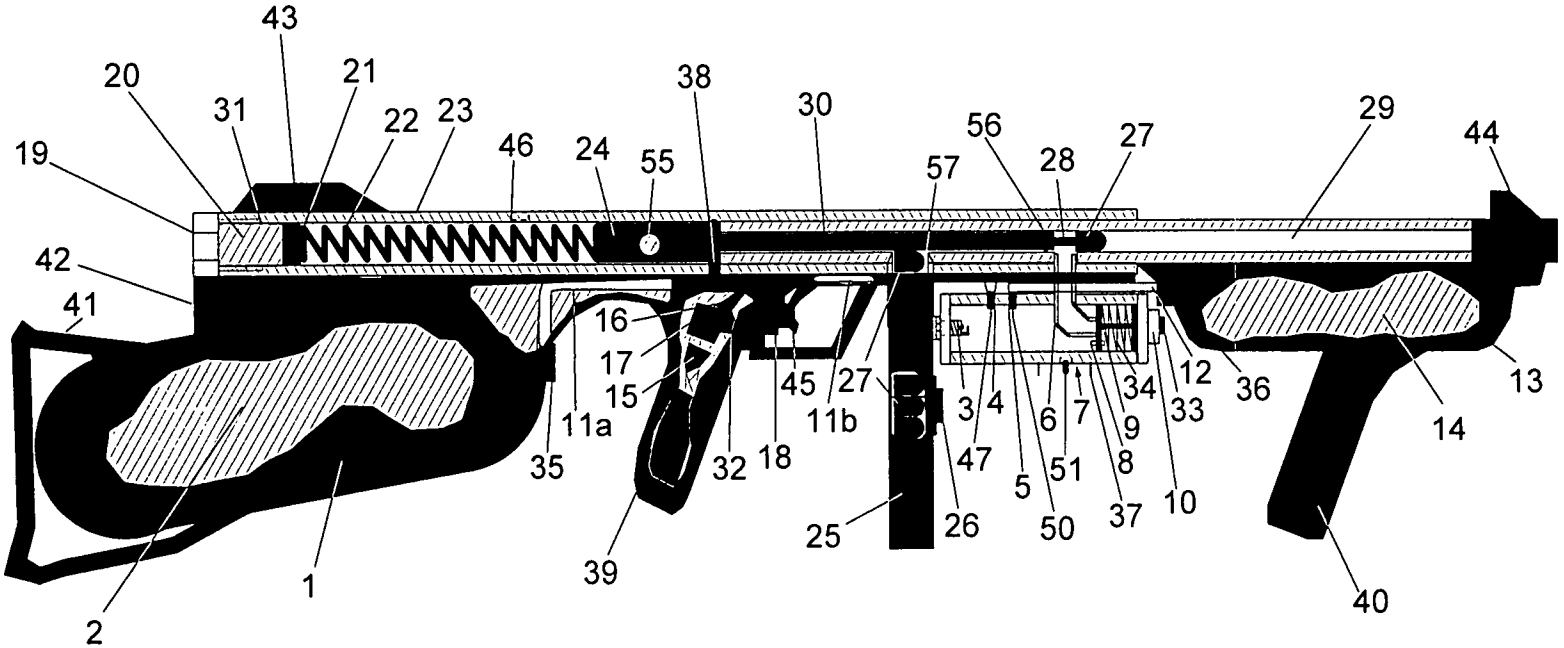
FIG. 3 depicts a side view of one arrangement in accordance with the functional view depicted in FIG. 1, but in a possible "commercial" form.

FIG. 3 depicts a side view of one arrangement in accordance with the functional view depicted in FIG. 1, but in a possible "commercial" form. The description is identical to that of FIG. 1, with the exceptions that the layout of the components is more ergonomic, and lower receiver 42 has been added. Additionally, optional components are not employed in this example. The overall construction of the combustion chamber/valve assembly is the same as that in FIG. 1 and FIG. 2. The lower receiver 42 includes rear handle 39, forward handle 40, shoulder rest 41, and trigger lever 45. It also contains oxidizer tank1 and fuel tank 13, which double as a stock and fore-grip, respectively. Ignition circuit 15 is shown in the cutaway of real handle 39, and includes the batteries, coil, circuit electronics, and wiring, depending on specific implementation. Rear sight 43 and front sight 44 are shown for one example, but any suitable sighting system can be used. Oxidizer tube 11 is depicted as 11*a* and 11*b* namely so that the oxidizer tube 11 routing may be more easily traced in the figure. In this embodiment, ammo holder 25 is shown as a drum with ammo holder spring 26 being a drum spring, but may also be a clip or other suitable ammunition holder such as a belt with a feeder. Upper receiver 23 is attached to lower receiver 42 via bolts or other suitable attachment method. In this embodiment, self-pressurized propellants are shown, but externally pressurized and/or pump-fed propellants could also be readily used.

Figure 4:
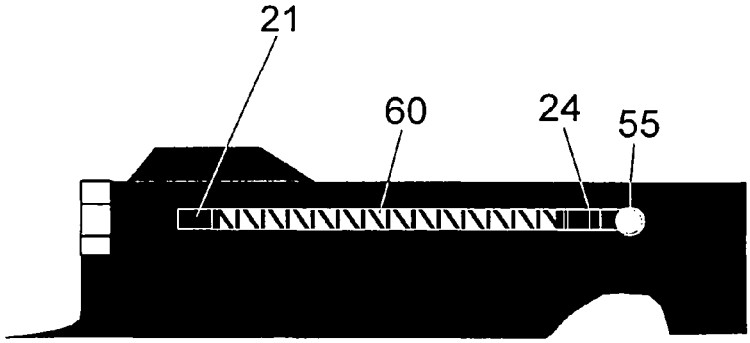
FIG. 4 is a non-cut away view of the rear portion of the embodiment shown in FIG. 3, namely to illustrate the location of the bolt handle slot 60 indicated in FIG. 3.

FIG. 4 is a non-cut away view of the rear portion of the embodiment shown in FIG. 3, namely to illustrate the location of the bolt handle slot 60.

Materials and Sub-Components

Material selection is highly dependent on the specific application, propellant selection, operational requirements, and other factors. As an example (and this is by no means inclusive of all possible materials) the embodiments shown could use 1118 steel for the barrel, stainless or mild steel for the combustion chamber or possibly a copper or a suitable aluminum alloy combustion chamber, hardened 1040 steel for the bolt, common spring steel for the compression springs, steel or high strength aluminum for the upper receiver, high temperature steel-backed neoprene for the valve seal, stainless, mild steel or copper for the valve tube, steel braided lines for the propellant, carbon-fiber metallic lined composite tanks for the compressed air and fuel tanks, assorted mild steels and/or aluminum for the interconnecting components and lower receiver, a small ignition coil, spark plug, battery, and optional capacitor for the ignition circuit, depending on implementation. A simple 555 timer, micro-controller based, or other type of trigger delay circuit could be used for optional selective fire settings that would be specific to the type of device constructed. Standard or custom micro-switches for the trigger and bolt switch (of any suitable design including, but not limited to, mechanical, magnetic, or optical devices), thin mild steel or aluminum for the ammo holder which is constructed in a similar fashion to traditional cartridge based clips/drums and/or other projectile feed mechanisms. The projectiles may be constructed from any suitable material, depending on the applications, including hard materials such as depleted uranium, lead, bismuth, steel, etc., as well as softer materials such as rubber, sponge, plastic, wood, etc., and/or anything in-between or combination thereof. Projectiles, including grenade/exploding rounds, thermobarics, seekers, multi-pellet shot, slugs, non-lethal shot, and other types of projectiles could also be used depending on the application. All materials listed in this document are by no means inclusive of all such materials that could be used in the construction of the device, and such will be dependent on the specific application, implementation, and corresponding requirements.

Dimensions

An noted, the dimensions are highly dependent on the specific application and design requirements, and can vary greatly within the same basic functional type of embodiment. For example, and this is by no means inclusive, the embodiment in FIG. 1 may use a 20" long barrel (say as measured from the rear of the loaded projectile, with bolt forward, to the muzzle) of say 0.30 caliber. Assume, for sake of example, that the barrel chosen is .30 caliber. Then, the rest of the dimensions are taken roughly in proportion to those shown in FIG. 1 through FIG. 4, adjusting as required for the specific implementation. For instance, based on FIG. 1, a 0.30 caliber barrel can result in a combustion chamber/valve assembly of approximately 0.75" in inner diameter, and about 2.7" long, having roughly 15 ml of combustion chamber volume (not including the area behind the piston valve). Again, these are just examples and such dimensions are highly dependent on the application and specific design requirements.

Operation of Embodiment

Note that it is recommended to reference FIG. 1 when following the operation of the device, except where noted. FIG. 2 is an enlarged view of the combustion chamber/valve assembly 7 and can also be referenced in regards to the operation of that assembly. FIG. 3 is identical in operation to FIG. 1 (as described in the description section), but FIG. 1 shows a larger view of the internal mechanisms.

In operation, the user loads ammo holder 25 with projectiles 27, similar to loading a clip in a traditional cartridge-based weapon; in this embodiment, the ammo holder may be gravity-fed (for example, top mounted) and/or spring fed. In this particular embodiment, the ammo holder is a retainer-free clip whereby the projectiles are allowed to freely enter loading port 57 (via the ammo holder spring 26) rather than being retained by the ammo holder and subsequently force loaded by the bolt. One loads a suitable oxidizer 2 into oxidizer tank 1, and a suitable fuel 14 into fuel tank 13. For descriptive purposes of this embodiment, the oxidizer may be compressed air, but could also be any suitable oxidizer that is compatible with the tank, the selected fuel, and the propellant delivery mechanisms including the propellant regulators, valves and optional pumps. Such oxidizers include (but are not limited to) oxygen, nitrous oxide, hydrogen peroxide, nitric acid, and so forth. Again for descriptive purposes of this embodiment, the selected fuel may be propane, but it could also be gasoline, alcohol, HAN (as mono-propellant), acetylene, hydrogen, or any fuel compatible with the tank and chosen propellant delivery system including the propellant valves and/or optional pumps.

The populated ammo holder 25 is inserted into upper receiver 23 (and/or through lower receiver 41 as shown in the FIG. 3 "commercial" embodiment) and the ammo holder spring 26 is released, allowing the projectiles to move upwards by the force of the ammo holder spring. The oxidizer regulator/valve 35 and fuel regulator/valve 36 are then opened, filling the combustion chamber through the fuel check valve 5, fuel injector 50, oxidizer check valve 4, and oxidizer injector 47. This fills the combustion chamber with both fuel and oxidizer up to a predetermined amount and pressure with the propellant constituents based on the respective regulator pressures, check valve operation, and respective propellant injector sizes. As noted for this embodiment, compressed air and propane may be used as oxidizer 2 and fuel 14, respectively. In such a case, for example, the compressed air pressure may be selected to have a much higher output pressure from its regulator than the propane. Thus, the propane fuel check valve must not close before the chosen partial pressure of the propane reaches its designed value; if the force on the fuel check valve due to the overall chamber pressure exceeds the force exerted by the propane vapor pressure on the fuel check valve, the valve will close. It is therefore necessary to select/design the injectors to insure that the flow rate of the propellants is adjusted to allow the designed for mixes at the selected design pressure, which may be variable in this embodiment. Such a selection can be accomplished experimentally via adjustable orifice plate injectors and/or mathematically via numerical and/or classical techniques. The actual selection is dependent on the application of the embodiment.

Alternatively, oxidizer check valve 4 can instead be replaced by a pressure actuated valve assembly. In this case, the pressure activated valve will open when the pressure in the combustion chamber reaches some preset design pressure. For instance, if propane is the fuel and expected to be present at 10 PSI in the combustion chamber, the propane can be injected via a 10 PSI regulator. The pressure activated valve will open when the combustion chamber pressure reaches this 10 PSI. This allows the oxidizer to fill the combustion chamber up to the oxidizer regulator pressure, and also forces the fuel check valve closed. Some adjustment of the regulator and pressure switch would be expected for tuning operation. Still other alternative embodiments may employ electronically controlled solenoid valves rather than check valves and/or pressure actuated valves to help adjust the flow rate and mix.

The device is then cocked by pulling bolt 30 toward the back of the device via bolt handle 55. This allows the stack of projectiles 27 to move (as it is no longer blocked by bolt 30) and pushes one of the projectiles through loading port 57 and into the loading position. Allowing bolt 30 to slide forward pushes the available projectile from this loading position to a position beyond gas port 6. The shape of the bolt face 28 can also allow a small gap between the projectile and the bolt for a gas path. The forward location of the bolt activates bolt switch 38, which is in series with trigger switch 18 (both need to become active, meaning 'open' when using normally closed switches, for the ignition circuit to activate). The device is now primed, armed, and ready to fire.

Firing the device is accomplished by activating (opening) trigger switch 18, which allows ignition circuit 15 to send a high voltage pulse into combustion chamber/valve assembly 7. ignition circuit 15 can be comprised of any suitable high voltage circuit capable of generating enough voltage to create an ignition arc in the selected mixture. In this embodiment, a simple circuit may be used, employing a small automotive/motorcycle ignition coil, 12v @ 2 ah battery, and an optional suitable capacitor arranged in typical fashion to create a suitable spark (if capacitor is used, the value may depend on coil and design, for instance, it could range from 0.01 uF to 10 uf, or other values as required; capacitor may experience an inductive kickback and should be rated to withstand such a kick voltage; it may be any voltage rating suitable for the coil and ignition circuit). Both trigger switch 18 and bolt switch 38 are normally closed in this example (since most ignition coils will trigger on a circuit break, opening the switch will enable the spark from the coil). The resulting spark ignites the mixture and creates an overpressure inside the combustion chamber. In the case of compressed air and propane with a stoichiometric mix, this is roughly 8.2× the starting combustion chamber pressure. The overpressure holds fuel check valve 5 and oxidizer check valve 4 closed, while forcing piston valve 9 open, allowing the high pressure gas to enter gas port 6. Any residual gas on the other side of the piston may be vented via piston vent 33, which can take several constructions as described in the above description section. If the piston vent 33 is implemented as an unsealed vent hole, then piston valve 9 may also need to seal off the combustion chamber section of combustion chamber/valve assembly 7 when the piston valve 9 becomes fully open (via an internal ridge or other construct, located in the combustion chamber/valve assembly just before the fully open piston valve position). The high pressure gas expands through gas port 6 into barrel 29, pushing on both the projectile and the bolt, propelling the projectile down the barrel and the bolt backwards.

The bolt is significantly more massive than the projectile (for instance, maybe 40× but this depends largely on the selection of the ammunition, designed repetition speed, and other design choices); bolt 30 is also supported by bolt spring 22. Thus, the bolt has a slow rate of travel backwards compared to the forward projectile motion and the projectile leaves the barrel far before the bolt has moved a significant distance. For instance, a bolt 40× more massive then the projectile will accelerate 40× slower under the same force. As both the bolt and projectile are subject to the same force in this embodiment (initially neglecting the spring), and acceleration is inversely proportional to the mass, the velocity, v=at, will be proportional to the average force as v=(F/m)t, or distance=(0.5)(F/m)t^2. During some time interval 't', the distance is simply a function of the force and mass. In this particular implementation, the force is the same for both the bolt and the projectile and thus the distance is in linear inverse proportion to the mass. As such, a 40× greater bolt will travel $1/40^{th}$ the distance in the same time period (again, neglecting the additional spring force which may or may not be significant depending on the implementation). In the time period it takes the projectile to traverse a 20" barrel, for instance, the bolt would have traveled 0.5." The force on the bolt after the projectile leaves the barrel is primarily the force of bolt spring 22 alone, since the remaining pressure is quickly vented through the barrel. The force of the bolt spring 22 must then overcome the backwards momentum of the bolt to cycle the action. Thus, the spring is chosen to allow effective cycling of the action, allowing the bolt to retract back to the bolt stop 21 (or, if desired, some intermediary point). By adjusting the spring tension, bolt length, ammo feed position, and the gas port position, it is possible to design devices with wide velocity ranges that can still reliably cycle. A particular bolt spring, for instance, could allow a reasonably heavy bolt to retract all the way to the stop under less force, resulting in enabling lower velocity projectiles while still effectively cycling the action. The lower retraction speed of the bolt (and optional bolt o-ring 56, if required for performance) prevents combustion gas from reaching ammo holder 25 or other areas in upper receiver 23 until the pressure drops to a safe level. In some cases, optional vents 46 may by used to help insure there is no pressure buildup inside the upper receiver, however the bolt handle slot used for the bolt handle in the upper receiver (see FIG. 4, bolt handle slot 60, for the placement of the bolt handle slot) will typically be adequate for venting.

When the projectile leaves the barrel, the rapid pressure decrease also allows the piston valve 9 to close, and fuel check valve 5 and oxidizer check valve 4 to open. This initiates refilling of the combustion chamber with a fresh charge that can additionally assist in cooling the chamber depending on the propellants. If the alternative method using a pressure actuated valve assembly described earlier was employed, the rapid combustion chamber pressure decrease will cause the check valves to open and the pressure actuated valve to close, thus shutting off oxidizer flow to the combustion chamber until the pressure inside the chamber reaches the pressure actuated valve turn-on pressure, at which point the oxidizer will again flow into the combustion chamber, up to the design pressure.

As the bolt continues its backwards travel and passes loading port 57, another projectile is free to move through the loading port. As the bolt loses its backward momentum against the force of bolt spring 22 and is forced forwards, it pushes the projectile into the barrel past the gas port, thereby completing the cycle. If trigger switch 18 is held active during this time, the firing sequence will commence again when the bolt switch 38 also becomes active (again note that switches are normally closed in this particular example, so "active" indicates electrically open in this configuration). This enables ignition circuit 15 and re-fires the device. In this way, automatic operation can be achieved. If desired, a one-shot can be added to the ignition circuit to allow repeat firing only if the trigger switch is released and reactivated, thereby providing semi-automatic fire. Similarly, burst modes can be added by adjusting the delay off-time of the one-shot, causing the device to cycle several times before deactivating the trigger. Toggling these modes provides for selective fire capability. Variable velocity can be achieved by adjusting the pressure regulators, mixture ratios, and/or combustion chamber relief port 51, along with proper selection of the bolt mass and bolt spring for effective cycling.

Cooling fins 35 may be used to help maintain the wall/combustion chamber temperature at a particular value, if required. Such implementation specifics will vary depending on the fuel and oxidizer selection. In addition, with some propellants, expansion cooling will help cool the combustion chamber during the injection of a fresh charge, and may mitigate the need for such additional cooling. Similarly, the fins may be augmented or replaced via regeneratively cooling of the combustion chamber walls via routing the propellant or other cooling fluid to circulate through areas in contact with the combustion chamber walls. These choices depend on the particular fuel and propellant selections, and specific requirements of the particular implementation.

Note that the repetition rate may be low enough in many applications that certain propellants would not need such cooling to stave off any possible autoignition of the fuel/oxidizer mix. Unlike a gasoline automobile engine (which is successful at preventing autoignition under relatively difficult conditions), not only can applications have lower cycling rates, but the compression technique used in this particular embodiment is a function of the propellant regulators and valves, not a mechanically volumetric compression. Such significantly lowers the potential of cook-off and/or autoignition with many potential propellants. Still, other related embodiments may choose to alternatively implement autoignition/compression ignition techniques, such as using a driven compression piston rather than a using a pre-stored compressed air source, which could both compress and ignite the mixture. Such mechanical compression ignition techniques constitute yet another embodiment in accordance with this invention.

Propellants: Oxidizers and Fuels

Using compressed oxygen or other compressed and/or liquid oxidizers (such as nitrous oxide) can result in over-pressures up to (and possibly beyond) 5× greater than air. This allows for the creation of relatively high power devices that can significantly exceed the performance of cartridge-based projectile weapons. Note that detonations (as opposed to deflagrations) may also be more likely to occur with such oxidizer mixtures, depending on combustion chamber design. Certain combustion chambers could be designed to take advantages of such detonations, thus providing even higher pressures and greater power.

Fuel Pumps & External Pressure Tanks

In mono, bi-propellant, or other configurations, pumps or separate pressure tanks may be used for injecting the propellants into the combustion chamber, instead (or in conjunction with) the self-pressurized tanks as shown in the embodiment. FIG. 1 shows optional oxidizer pump 48 and optional fuel pump 49 in line with their respective propellant feed tubes. In the case of a pump-fed system, any or all of the propellants could be forced into the combustion chambers by way of these propellant pump(s) (for instance, electric or gas driven pumps). In the case of external pressure feeding, a separate compressed gas tank (air, nitrogen, helium, etc.) could be used. FIG. 1 shows one possible layout for an optional external pressure tank 52 and regulated oxidizer feed line 53 and regulated fuel feel line 54. Depending on the application, the pressure and/or propellant tank orientation may become important in such an embodiment. Specific applications, propellants, and other design choices may demonstrate certain advantages using one technique as opposed to another, or via a combination of techniques. For instance, compressed air may be used with a liquid fuel (such as alcohol, gasoline, etc.) via a fuel venturi where the force of the compressed air forces an adjustable amount of fuel into the combustion chamber thereby causing reasonable fuel atomization while filling the combustion chamber with a ignitable mix.

Optional Propellant Routing

It is possible to route the propellant through a valve assembly 10 on the rear of the combustion chamber/valve assembly 7. In doing to, it may be possible to reduce the strength requirements on valve spring 34 by using the propellant as a gas-spring. In this case, the propellant fills the combustion chamber through optional check valve 8 located in piston valve 9. After the device is fired, the propellant valves located on valve assembly 10 is closed via the action of the opening of piston valve 9 and vent 33, similar to the operation of valves 4 and 5.

Materials

The materials used in construction should be suitable to handle the pressures and temperatures in various parts of the device. For instance, if the pressure in the combustion chamber is 5,000 PSI, it must be able to handle this pressure at the operating temperature, plus any margin and safety factors. Because of the wide range of pressures that could be designed for the unit, materials selection will be largely a function of the application of the unit and the specific design choices. For instance, a recreational and/or non-lethal device which shoots paintballs and/or some other form of soft projectiles at relatively low velocity, may also have relatively low pressure requirements; this could potentially allow a lower material strength requirement, etc.

Residual Heat and Autoignition

As mentioned in the earlier description, cooling techniques for the combustion chamber will depend on the types of propellant, design pressures, materials selection, application specifics, and other such factors. To prevent auto-ignition in this type of embodiment, the temperature of the combustion chamber should remain below the autoignition temperature of the mixture when a charge is filling. Depending on the cycling times, propellant, and propellant delivery system, this may or may not require some cooling of the combustion chamber walls. Both passive and active cooling systems may be employed, or if the materials, specifications, and propellant selections allow, such may not be required. Moreover, the thermal mass and size of the combustion chamber can be adjusted, tailoring heat transfer characteristics. Thus, such auto-ignition effects should be readily controllable in most applications, and potentially easier and more controllable than in cartridge-based or caseless-cartridge based weapons.

Other

There are various additions that could be used with the method that are not shown in this particular embodiment. For example, one item could be a projectile extraction lever, for instance, that could easily extract the projectile to make unloading the weapon simpler. While such items are nice-to-haves, they are not critical to the basic functionality.

Non-Inclusive Alternative Variations/Modes and Options for Above Embodiment(s):

1) Propellant Flow and Injection

One variation (as mentioned earlier) is the use of solenoid valves rather than check valves for propellant delivery into the combustion chamber. This allows the use of other control methods, such as electronic control of the solenoid valves, rather than relying on the timing of the cycle, check valves, and/or pressure actuated valves for propellant injection. Such also allows further control over the propellant mixture. Similarly, the propellant injectors may take various forms as appropriate for the implementation.

2) Propellants

Another variation is the use of a mono-propellant rather than a bi-propellant. Such would employ one injector and set of plumbing rather than two. Similarly, a tri-propellant could also be used, and thus use three sets of plumbing. Other combinations of propellant formulations (i.e., quad-propellant, etc.) would adjust their plumbing accordingly. Sill another option is to use hypergolic propellants; in such a system, the ignition circuit would be replaced by a secondary valve control system and/or injection mechanism. Still another option is to use a liquid ignition system with any of the aforementioned propellant options, whereby an injected liquid ignites the propellant(s). Note that compression ignition techniques as used in some alternative embodiments may use any propellant and/or combination of propellants suitable to the function and application of an embodiment.

3) Bolt-Pump

Another alternative embodiment is to compress air taken from the surrounding atmosphere. In such an embodiment, the recoiling bolt would serve as a pump to compresses air into a shot reservoir (which could be the combustion chamber itself). Such would be possible alternative, and this functions similar to a two stroke engine, whereby the piston acts as both a pump and piston, but in a completely novel way, where compression is both via the pump tube on the reverse compression of the recoiling bolt, and then on the forward motion of the bolt spring. Note that this is nearly identical to Embodiment 1, but replaces the oxidizer tank with a piston pump powered by the recoiling bolt. Overall operation is similar to Embodiment 1, with the exception that the air is now forced into the combustion chamber as the bolt recoils. Since the combustion valve is closed by the time any real compression takes place (and the injected air is also being fed through a check valve), reasonable air compression can be achieved. While this may or may not be able to match or exceed that by compressed air in a tank, certain applications my opt to use such a design as it could potentially mitigate the need to store a separate oxidizer.

Similarly, the bolt pump could be used to pump both a separate oxidizer and fuel, using the energy of the combustion to pump the propellant constituents. This would allow one possibility for using liquid oxidizers and liquid fuels without using external pumps.

4) Turbo-Charging

Another alternative embodiment is to replace the oxidizer tank and/or oxidizer propellant pump with an air pump. While this may or may not affect flexibility depending on the application, it can possibly mitigate the need for an oxidizer tank. In such an embodiment, a small air pump or turbine-driven air pump (electric and/or propellant and/or gas driven turbine) of suitable design could be used to compress the air into the combustion chamber. In the rest of the general operation, the device works the same fashion as Embodiment 1.

5) Combustion Chamber/Valve Assemblies

The combustion chamber/valve assembly can take various forms, with the functional intent being as described in this invention (including coaxial variants and others). Similarly, it is possible to create cup seals and other type of valve sealing and venting mechanisms in accordance with the invention.

6) Ignition Circuit

As noted earlier, the ignition circuit may take various form and need not be electronic. It can take any suitable form for the application, including mechanical ignition (i.e., flint sparker and/or piezo) and other methods.

The example embodiments and alternative variations presented are in no way inclusive to all possible embodiments or variations in accordance with the invention, and are simply to provide representative examples in accordance with the invention.

Advantages

From the description above, a number of advantages of my projectile propulsion method become evident—some of these include (but are not limited to):

General—Research/Scientific Device, Recreational, or Weapon

1. High projectile energy achieved with a powder-less system.
2. The use of case-less rounds allow for much higher firepower to mass and volume ratios, possibly exceeding 3× the mass and 4× the volumetric density in some implementations.
3. The flexibility of multiple modes of implementation, numerous propellant choices, and a wide rage of materials choices and implementation options
4. Various uses, ranging from recreation to weaponry; the device need not be a weapon and would have significant use outside of that domain.
5. No gunpowder is used and thus it would not be classified as a firearm in many areas, depending on the implementation
6. The device allows for implementation in single shot, full-automatic, and semi-automatic modes of operation, or a combination thereof (i.e., select-fire) an advantage not demonstrated in other gas or liquid powered projectile propulsion systems Weapon Specific 1. Weight/Volume Advantages. Up to 3× increase in firepower/mass and 4× (or greater) increase in firepower/volume over standard ammunition. Elimination of the cartridge case, the heaviest and most volumetric component of current ammunition. Significant reduction in propellant weight via more energetic fuels.
2. Ammunition Advantages. Reduction in ammunition cost, difficulty of storage and production.

Standard ammunition may consist of an inert projectile; explosive rounds do not need a special cartridge case. Alternative ammunition including air-burst devices, thermobarics, advanced non-lethal/less-than-lethal rounds, sabots, sheathed shot-shells and flechettes are well suited for the proposed technology.

3. Weapon Advantages. Variable velocity projectiles, including ranged non-lethal engagement capabilities.
4. Configurable caliber and weapon behavior possible via interchangeable barrels and adjustable propellant mix; variety of lethal and non-lethal ammunition can be used on the same weapon.
5. No cartridge ejection issues—elimination of cartridge "policing" and spent brass. Potentially better performance and reliability than existing weapons, including greater lethality and higher/adjustable rates of fire.
6. Design Advantages. Mechanical operation has pedigree with existing technologies. Wide applicability to several arms platforms with good scalability. Adaptable to future systems and unmanned vehicles; can be augmented with fire control and ballistic computers. Excellent potential; core technology is flexible and open to enhancements. True cartridge-free design without exotic materials, special energy sources, or special propellants.

Conclusions, Ramifications, and Scope

Accordingly, the reader will see that the invention as described and further illustrated in an example embodiment provides an effective and advantageous method for projectile propulsion. Moreover, it is superior to existing systems from both implementation and functional perspectives. Further, it provides additional advantages in flexibility, efficiency, weight, and logistics over the existing art. The invention has the additional advantage that it can be used in a wide variety of devices, from scientific and recreational devices to weapons systems, with advantages in every category, and additionally includes such advantages as variable velocity projectiles and full-automatic firing options.

The example embodiments and alternative variations presented are in no way inclusive to all possible embodiments or variations in accordance with the invention, and are simply to provide representative examples in accordance with the invention.

I claim:

1. A method for launching a projectile from a projectile launcher, the method comprising:

a) providing a combustion chamber, wherein a predetermined first pressure in said combustion chamber prior to combustion is selected from ambient pressure to above ambient pressure;

b) providing at least one propellant comprising at least one propellant constituent, wherein said at least one propellant constituent at least partially comprises a gas or vapor state prior to combustion in said combustion chamber;

c) injecting said at least one propellant constituent into said combustion chamber through at least one injector, wherein a pressure at injection is greater than said first pressure;

d) igniting said at least one propellant within said combustion chamber to produce combustion gases; and, e) opening a piston valve in response to said combustion gases, wherein said piston valve comprises a piston and a gas port; wherein moving said piston releases said combustion gases through said gas port, and further wherein said combustion gases pass though said gas port to generate a motive force within said projectile launcher.

2. The method of claim 1 further including cooling said combustion chamber.

3. The method of claim 1 further including allowing said combustion gases to pass through said gas port directly to a barrel of said projectile launcher in order to propel a projectile via said motive force.

4. The method of claim 1 further including allowing said piston valve to be at least partially biased into a closed position by said first pressure in said combustion chamber.

5. The method of claim 1 further including allowing operation in at least one automatic mode including semi-automatic mode, fully-automatic mode, burst-automatic mode, or combinations thereof.

6. The method of claim 1 wherein said gas port is opened or closed concurrently with a motion of said piston.

7. The method of claim 1 wherein said piston comprises a sealing means for said gas port.

8. The method of claim 1 wherein said piston valve opens said gas port in response to said combustion gases without solid on solid impact forces.

9. The method of claim 1 wherein said piston valve serves as a main valve, secondary valve, or any subsequent valve stage.

10. The method of claim 1 wherein said piston operates via differential pressure without a solid return spring.

11. The method of claim 1 wherein said piston valve comprises a poppet valve.

12. The method of claim 1 further including metering said at least one propellant constituent.

13. The method of claim 1 further including transferring at least some of said combustion gases out of said combustion chamber through a fixed or configurable vent.

14. The method of claim 1 further including adjusting at least one operational parameter including valve dwell time, rate of tire, muzzle energy, or combinations thereof.

15. A combustion operated projectile launching device comprising:

a) a piston valve comprising a piston and a gas port, wherein said gas port is normally closed by a first position of said piston;

b) at least one propellant comprising at least one propellant constituent;

c) means for injecting said at least one propellant constituent into a combustion chamber at an injection pressure above ambient pressure, wherein said piston valve retains said at least one propellant constituent in said combustion chamber prior to combustion; and, whereby ignition of said at least one propellant in said combustion chamber creates a pressure motivating said piston thereby actuating said piston valve and thus controlling a flow of combustion gases through said gas port to generate a motive force within said combustion operated projectile launching device.

16. The projectile launching device of claim 15 further including means for allowing operation in at least one selectable mode including single shot, semi-automatic, fully-automatic, burst-automatic, or combinations thereof.

17. The projectile launching device of claim 16 wherein said means for allowing operation in one or more selectable modes is an electrical circuit, mechanical device, or combinations thereof.

18. The projectile launching device of claim 15 wherein said combustion chamber comprises at least one means for controlling at least one operation including cooling, venting, transferring combustion gases from said combustion chamber, or combinations thereof.

19. The projectile launching device of claim 15 further including a means for allowing said combustion gases to pass through said gas port directly to a barrel of said combustion operated projectile launching device in order to propel a projectile via said motive force.

20. The projectile launching device of claim 15 further including a means for igniting said at least one propellant via an electrical means for igniting, mechanical means for igniting, chemical means for igniting, or combinations thereof.

21. The projectile launching device of claim 15 wherein said piston valve comprises a poppet valve.

22. The projectile launching device of claim 15 wherein said piston valve is directly operated via expanding combustion gases.

23. The projectile launching device of claim 15 wherein said piston valve opens in response to combustion gases without solid on solid impact forces.

24. The projectile launching device of claim 15 wherein said piston valve serves as a main valve, secondary valve, or any subsequent valve stage.

25. The projectile launching device of claim 15 wherein said piston valve operates via differential pressure without a solid return spring.

26. The projectile launching device of claim 15 further including a means for returning said piston to a predetermined position.

27. The projectile launching device of claim 15 further including a means for controlling at least one operational parameter including dwell time, rate of fire, muzzle energy, or combinations thereof.

28. A combustion operated projectile launching device comprising:

a) a piston valve comprising at least one piston and at least one gas port, wherein said piston valve is at least partially biased towards a closed position by a first pressure on said at least one piston, wherein said first pressure is at least partially generated by at least one propellant constituent at least partially residing in a combustion chamber prior to combustion.

29. The projectile launching device of claim 28 further including at least one injector for injecting said at least one propellant constituent into said combustion chamber at an above ambient pressure.

* * * * *